US008061279B2

(12) United States Patent
Preiss

(10) Patent No.: US 8,061,279 B2
(45) Date of Patent: Nov. 22, 2011

(54) FURNITURE WITH CABLE CHANNEL

(75) Inventor: Jürgen Preiss, Raubling (DE)

(73) Assignee: Steelcase Werndl AG, Rosenheim (DE)

( * ) Notice: Subject to any disclaimer, the term of this patent is extended or adjusted under 35 U.S.C. 154(b) by 267 days.

(21) Appl. No.: 12/298,212

(22) PCT Filed: Apr. 26, 2007

(86) PCT No.: PCT/EP2007/003703
§ 371 (c)(1),
(2), (4) Date: Feb. 3, 2009

(87) PCT Pub. No.: WO2007/128432
PCT Pub. Date: Nov. 15, 2007

(65) Prior Publication Data

US 2010/0024687 A1 Feb. 4, 2010

(30) Foreign Application Priority Data

May 9, 2006 (DE) ..... 20 2006 007 424

(51) Int. Cl.
*A47B 37/00* (2006.01)

(52) U.S. Cl. ..... 108/50.02; 312/223.6

(58) Field of Classification Search ..... 108/50.01, 108/50.02, 23; 312/223.6, 223.2, 223.3, 312/223.1
See application file for complete search history.

(56) References Cited

U.S. PATENT DOCUMENTS 4,224,769 A * 9/1980 Ball et al. ..... 52/36.1
5,103,741 A * 4/1992 Grund et al. ..... 312/223.6
5,878,673 A * 3/1999 Kramer et al. ..... 108/50.02
5,934,201 A * 8/1999 Diffrient ..... 108/50.02
6,003,447 A 12/1999 Cox et al.
6,076,903 A * 6/2000 Vander Park ..... 312/196
6,202,567 B1 * 3/2001 Funk et al. ..... 108/50.02
6,410,855 B1 * 6/2002 Berkowitz et al. ..... 108/50.02
6,415,723 B1 * 7/2002 Kopish et al. ..... 108/50.02
6,435,106 B2 * 8/2002 Funk et al. ..... 108/50.02

(Continued)

FOREIGN PATENT DOCUMENTS

DE 295 05 055 5/1995

(Continued)

OTHER PUBLICATIONS

Office Action (granting decision) dated Mar. 8, 2010 in Russian counterpart application 2008148304/12.
International Search Report for PCT/EP2007/003703, mailed Jul. 24, 2007.

(Continued)

*Primary Examiner* — Jose V Chen
(74) *Attorney, Agent, or Firm* — Nixon & Vanderhye P.C.

(57) ABSTRACT

An improved item of furniture, especially a table with a cable channel, is characterized by the following features: on a mounting device there are base bodies lying offset from one another and positioned in the longitudinal direction of the cable channel. On each of the base bodies there is a support rail, each pivotable around a rotating axis, between a cabling position hanging down and a support position facing it and extending at least for the most part parallel to the cable channel, in the operating position the cable channel is raised up so far that the rotating axis lies underneath the cable channel. An abutment, lying offset from the rotating axis, is constructed on the support rails, wherein the cable channel in the dropped cabling position directly or indirectly rests on the abutment in a lower lying plane relative to the raised operating position.

15 Claims, 9 Drawing Sheets

U.S. PATENT DOCUMENTS

Figure 1A:
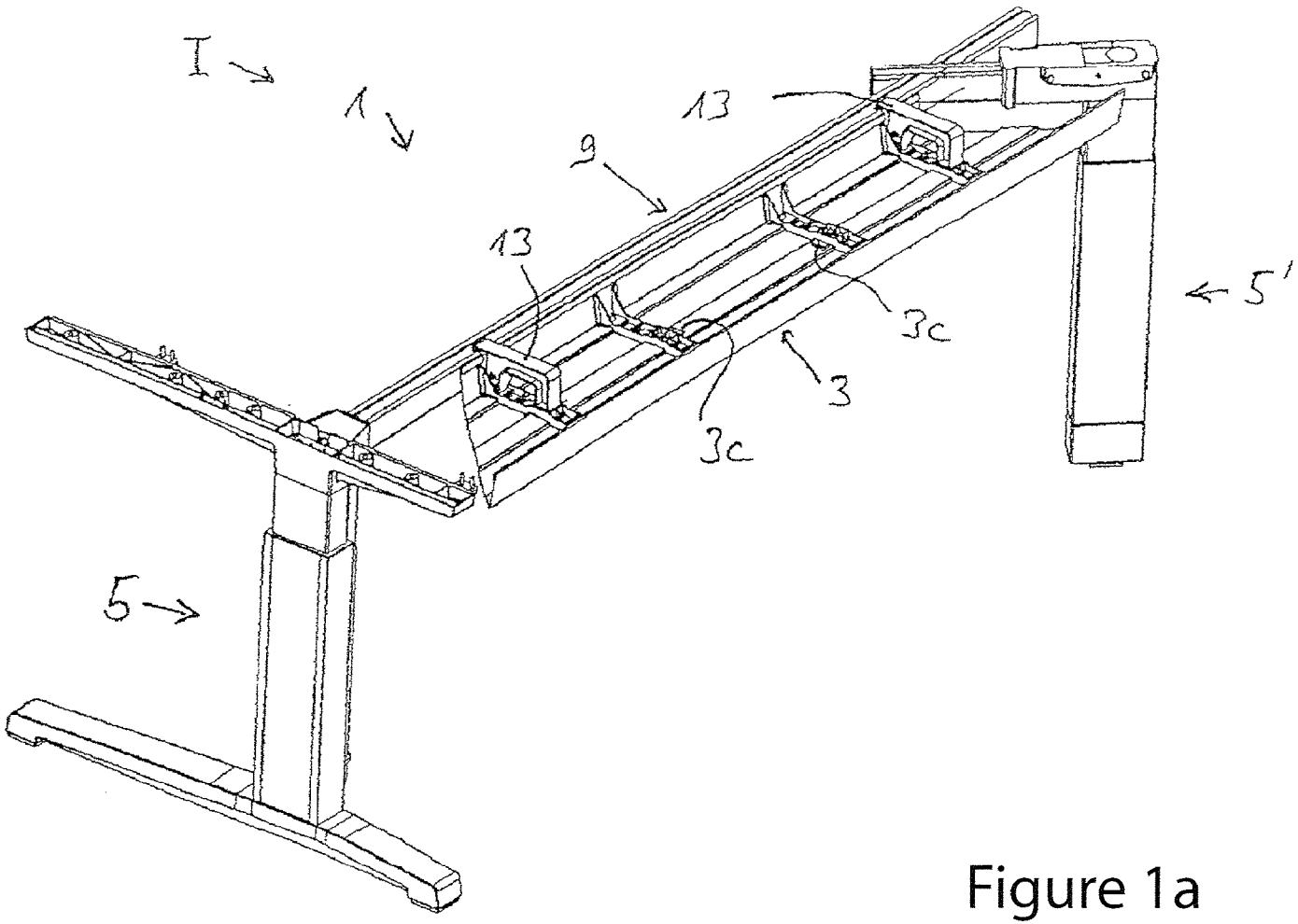

| | | | | |
|---|---|---|---|---|
| 7,066,097 | B2 * | 6/2006 | Gayhart et al. | 108/50.02 |
| 7,810,778 | B1 * | 10/2010 | Chang | 248/410 |
| 2005/0081761 | A1 * | 4/2005 | Chang | 108/50.02 |
| 2006/0102054 | A1 * | 5/2006 | Warriner | 108/50.02 |

FOREIGN PATENT DOCUMENTS

| | | |
|---|---|---|
| DE | 2 297 903 | 8/1996 |
| DE | 196 40 024 | 4/1998 |
| RU | 1108021 A | 8/1984 |

* cited by examiner

FURNITURE WITH CABLE CHANNEL

This application is the U.S. national phase of International Application No. PCT/EP2007/003703, filed 26 Apr. 2007, which designated the U.S. and claims priority to German Application No. 20 2006 007 424.4, filed 9 May 2006, the entire contents of each of which are hereby incorporated by reference.

The invention relates to an item of furniture, especially a work or office table with a cable channel.

On the lower face of office and work tables it is known to provide cable channels in which the power and network cables etc. needed for electrification, office workplaces etc. can be laid.

Sometimes these cable channels are arranged at a sufficient distance below the lower face of a desk top, in order to provide working space, by means of which the cables can be put into the cable channel.

It has also already been proposed to design a work or desk top so that it can be hinged around a horizontal axis in order to access the cable channel located underneath.

The object of the present invention is to create a further improvement, which by simple means makes a cable channel fully accessible in order to be able to install cabling easily and without difficulty.

With the present invention however a simple but very efficient solution is created, wherein a cable channel—as is normally provided on the lower face of a work or desk top—is arranged between an operating position and a cabling position, in which it is fully accessible in order to lay and if necessary remove again corresponding cables in the cable channel.

In the operating position the cable channel is as usual provided underneath the desk top, wherein in accordance with the solution according to the invention it can be arranged almost without any relevant distance from the lower face of the desk top. This results in a space saving arrangement, wherein it is guaranteed that leg movement underneath the desk top is not disadvantageously restricted.

In order to be able to lay cables easily and simply, the cable channel however can be brought from this raised operating position into a cabling position, lower relative to the latter, wherein a comparatively large space is available between the upper face of the cable channel and the table or worktop lower face.

The cable channel according to the invention is held for example by means of one or preferably at least two base bodies, provided offset from one another and positioned in the longitudinal direction of the cable channel, which for example are supported or anchored on the desk top lower face or preferably on a side member running underneath the desk top parallel to the cable channel. This side member for example connects the support and foot structures of the table, rather provided on the front side.

Now, according to the invention two support rails arranged offset in the longitudinal direction of the cable channel, along which the cable channel can be lowered from its raised operating position to the cabling position, are preferably provided. In this dropped position the cable channel rests on the abutment. Depending upon the length of the support rail sufficient working space from the lower table face is made available for installing the cabling. After the cabling has been installed the cable channel can be again raised along the preferably at least two support rails, until the cable channel is again anchored in its characteristic upper operating position. The anchorage can be effected through correspondingly suitable means for example on the base body.

In a preferred embodiment the support rails pass through the cable channel, for which purpose this is provided with corresponding openings. At the same time the support rails are connected for example to the base body mentioned preferably around an upper-lying horizontal rotating axis, so that the cable channel can be raised so far that the horizontal rotating axis comes to lie underneath the cable channel. This permits the support rails, hanging down vertically to a greater or lesser degree in the dropped position of the cable channel, to be pivoted around their upper-lying vertical rotating axis for example by 90°, until they run parallel to the cable channel on its lower face and are connected to the cable channel lower face by a fixing device provided there, preferably a hinge or click mechanism. As a result the cable channel is held at the same time.

In a preferred embodiment of the invention it is proposed that the support rails on one or at least preferably two opposite sides, preferably on their opposite narrow sides, are provided with a corrugation, whose maximum outer distance is adapted to the opening in the cable channel, so that this cannot drop freely along the support rail when the support rail is pivoted downwards but, due to the friction effect generated as a result can be pushed slowly down.

The support rails, as mentioned, are preferably held by means of base bodies, which stand laterally away from the side member mentioned—which forms the preferred mounting device for the base bodies—and can be fastened thereto. At the same time the base bodies lying facing the side member are provided with a stop shoulder and with an opposite-lying clamp shoulder, as a result of which they are detachably fixed to the mounting device. The clamping shoulder in this case can be permanently connected to the base body preferably by a pivotal link, for example by means of a pivot or film hinge.

Figure 1B:
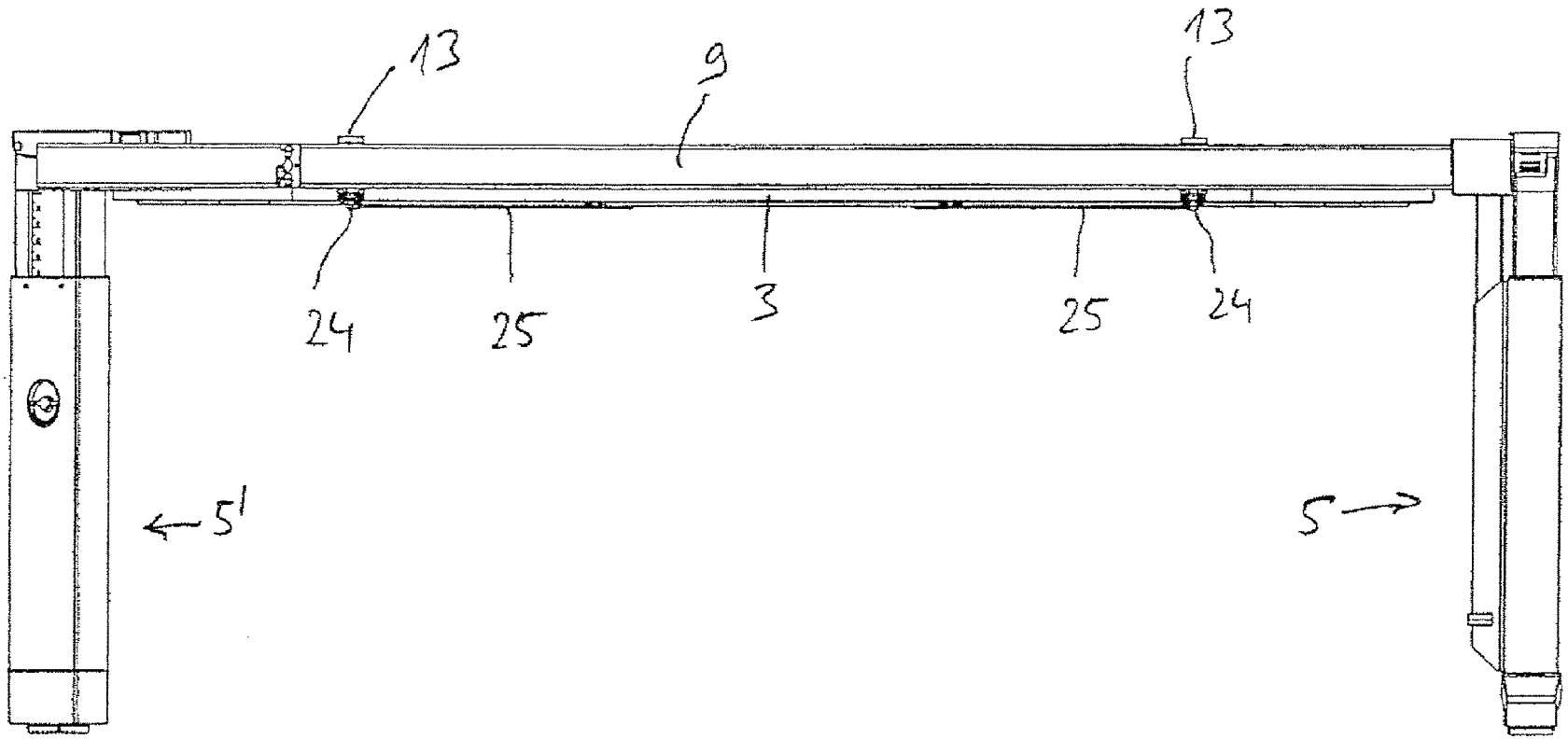

Further advantages, details or features of the invention will be clear from the exemplary embodiment illustrated by drawings, wherein there is shown in detail:

FIG. 1*a*: A perspective illustration in extracts of a work or office table with work or desk top omitted;

FIG. 1*b*: a frontal view of the table along the arrow direction I in FIG. 1*a;*

Figure 1C:
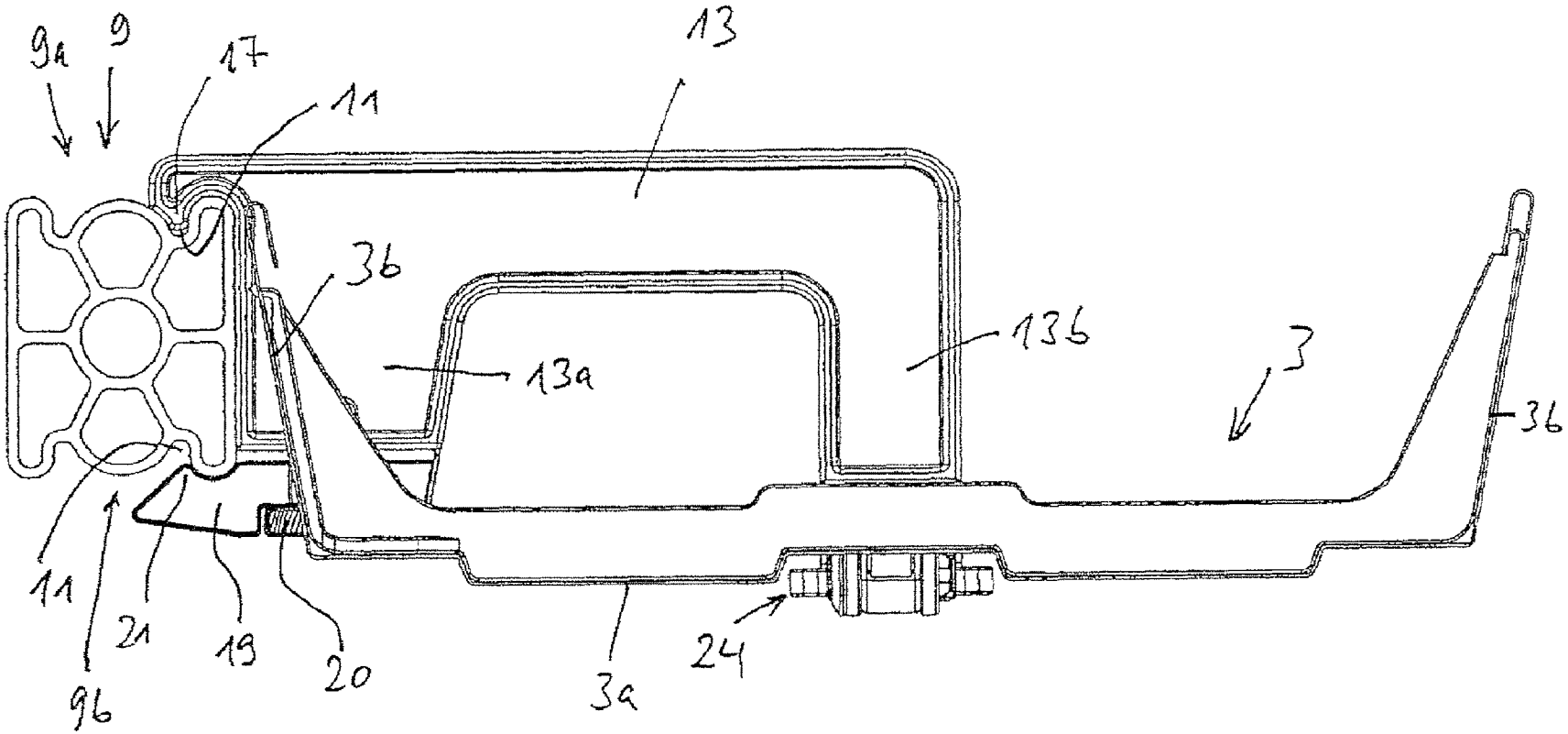
Figure 2A:
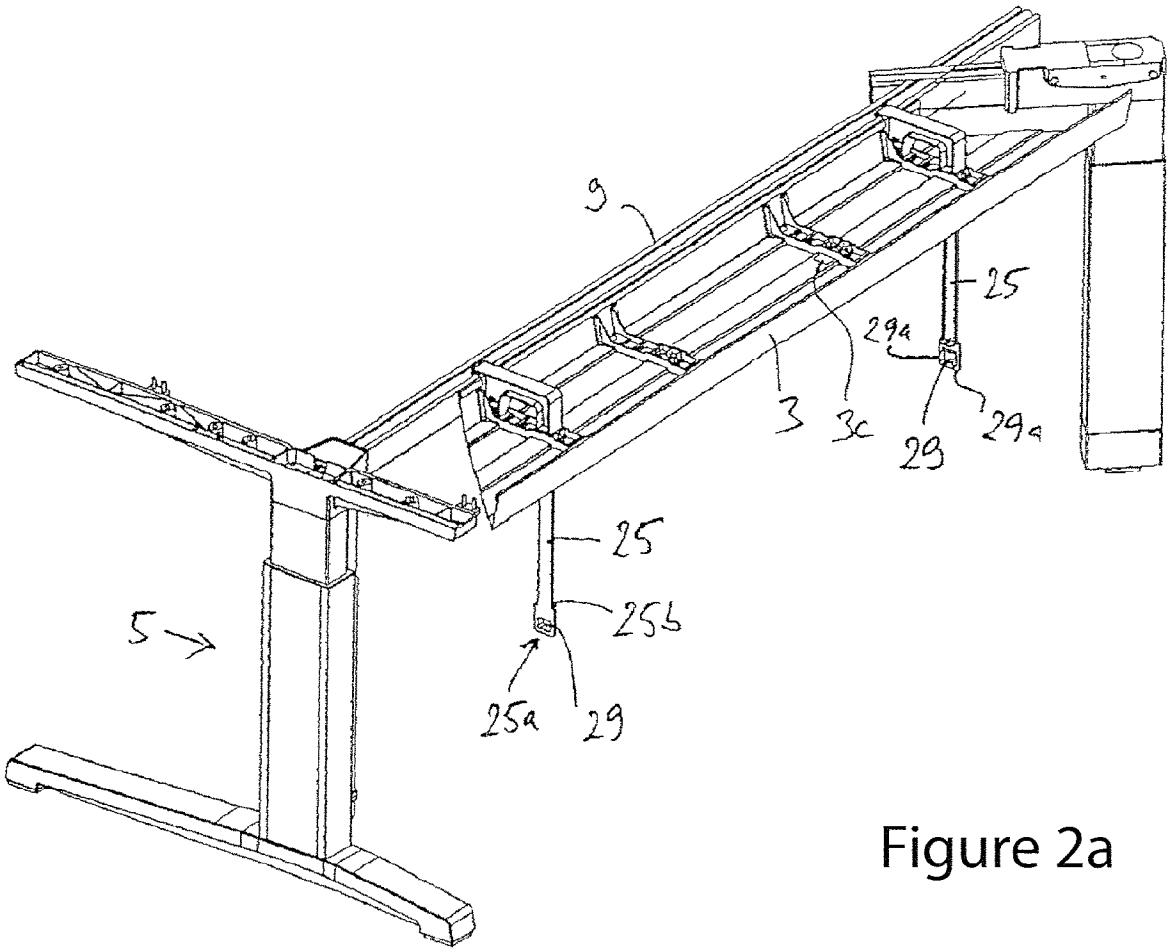
Figure 2B:
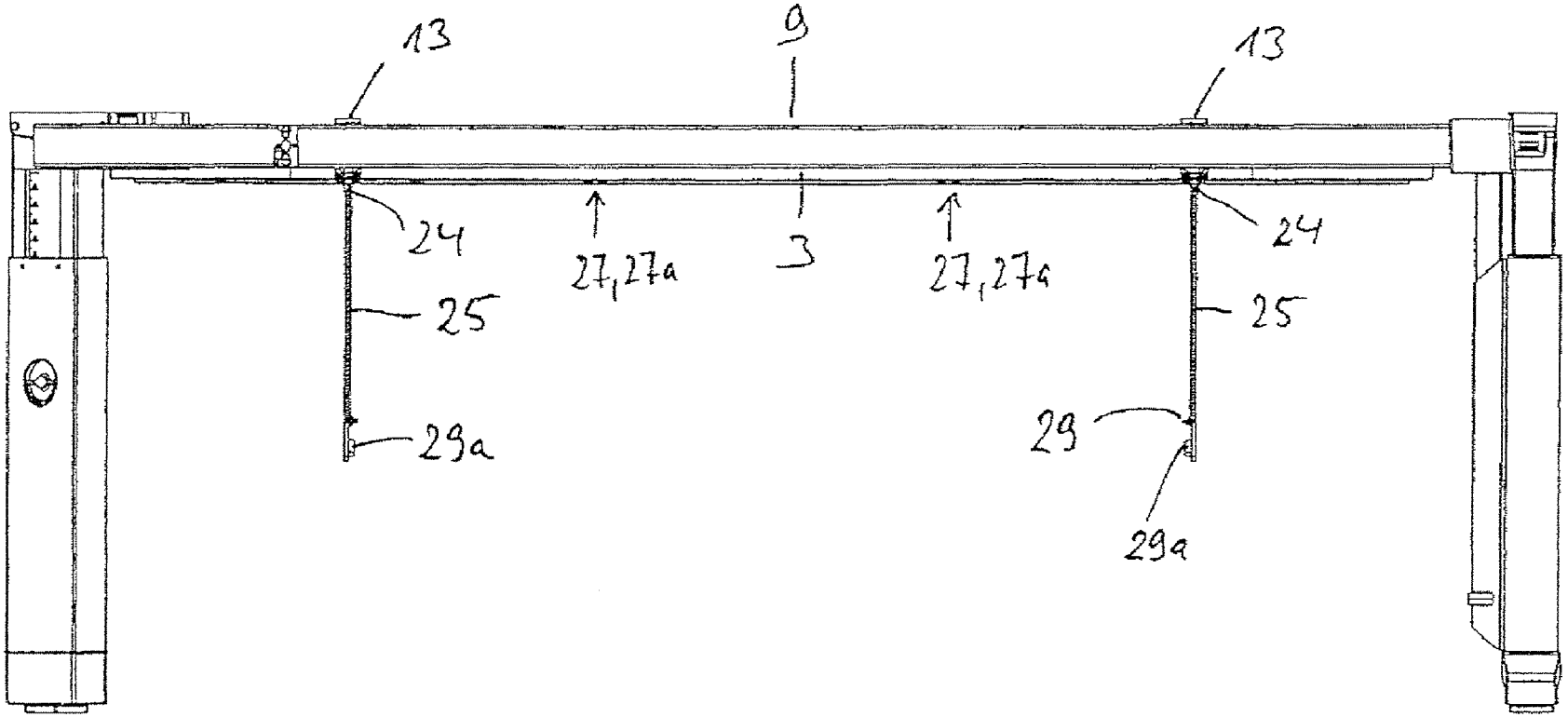
Figure 2C:
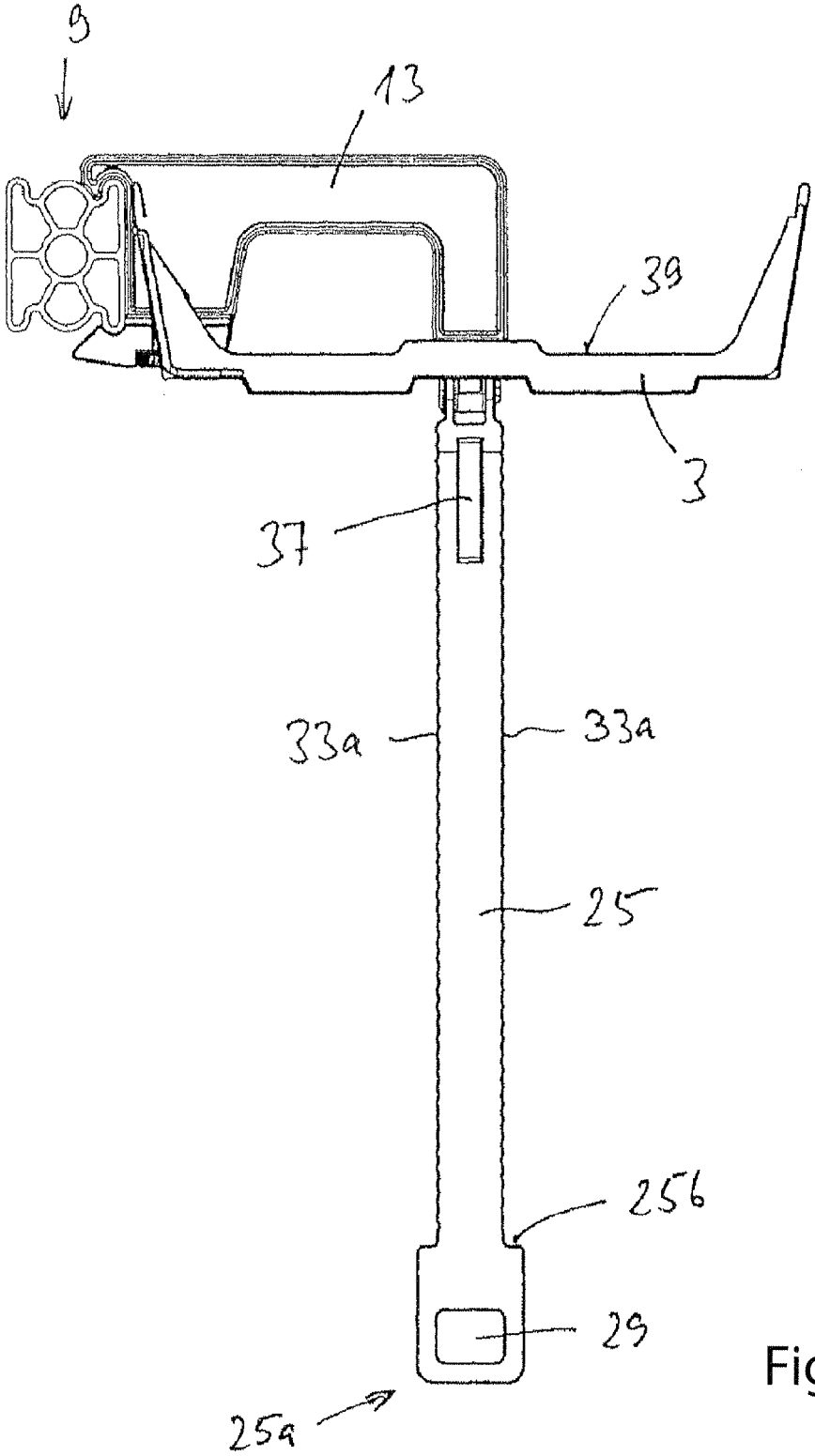
Figure 3A:
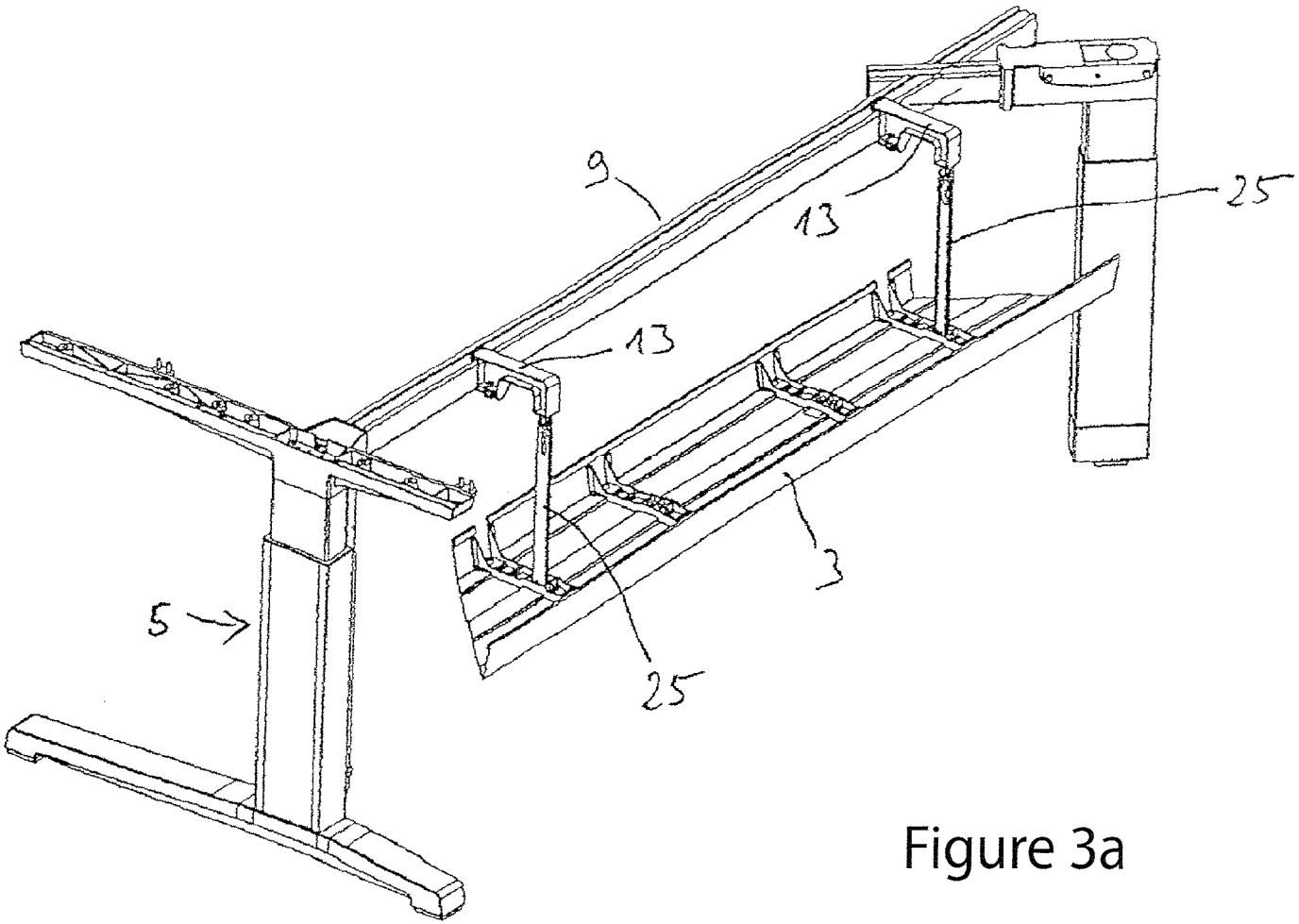
Figure 3B:
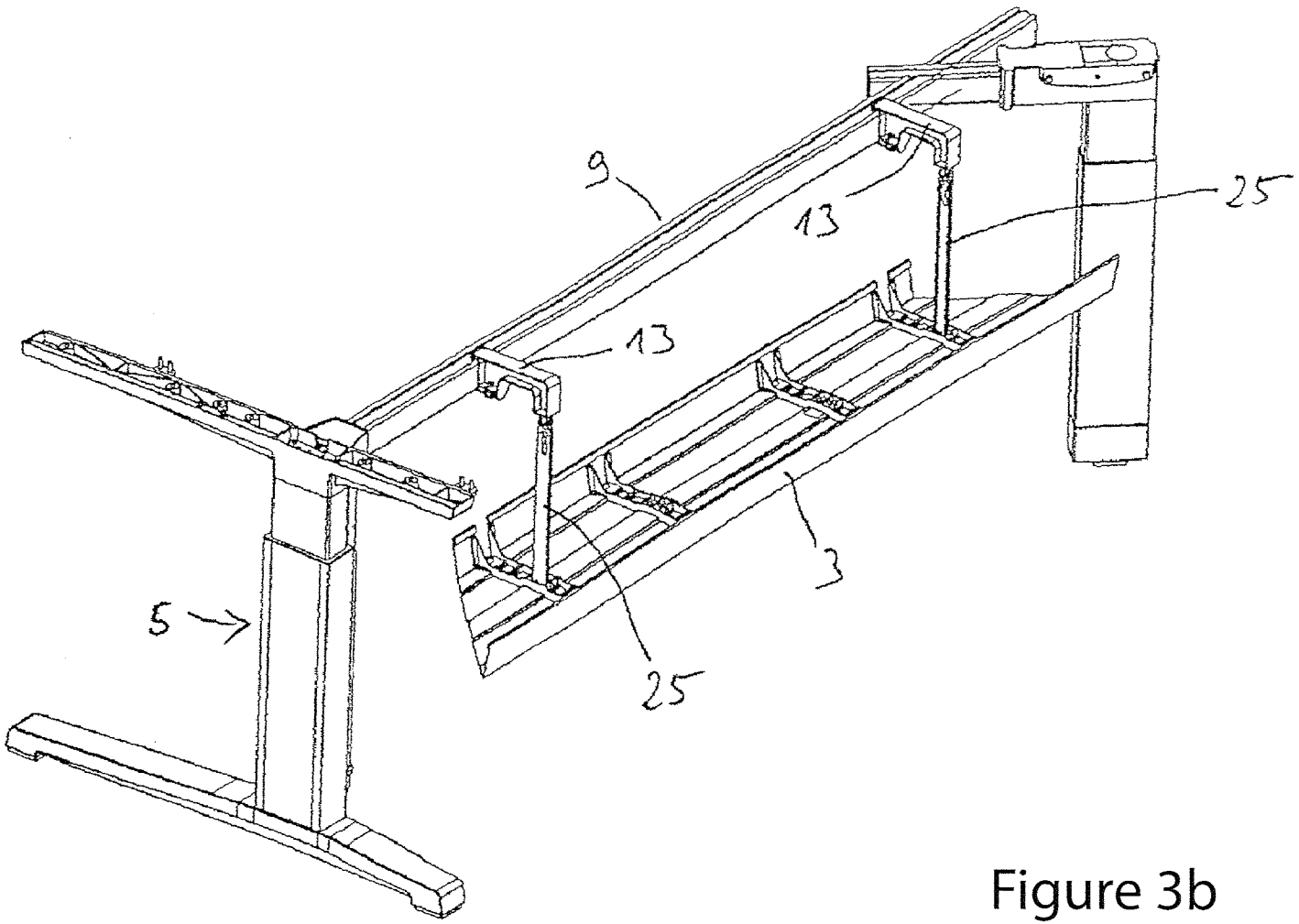
Figure 3C:
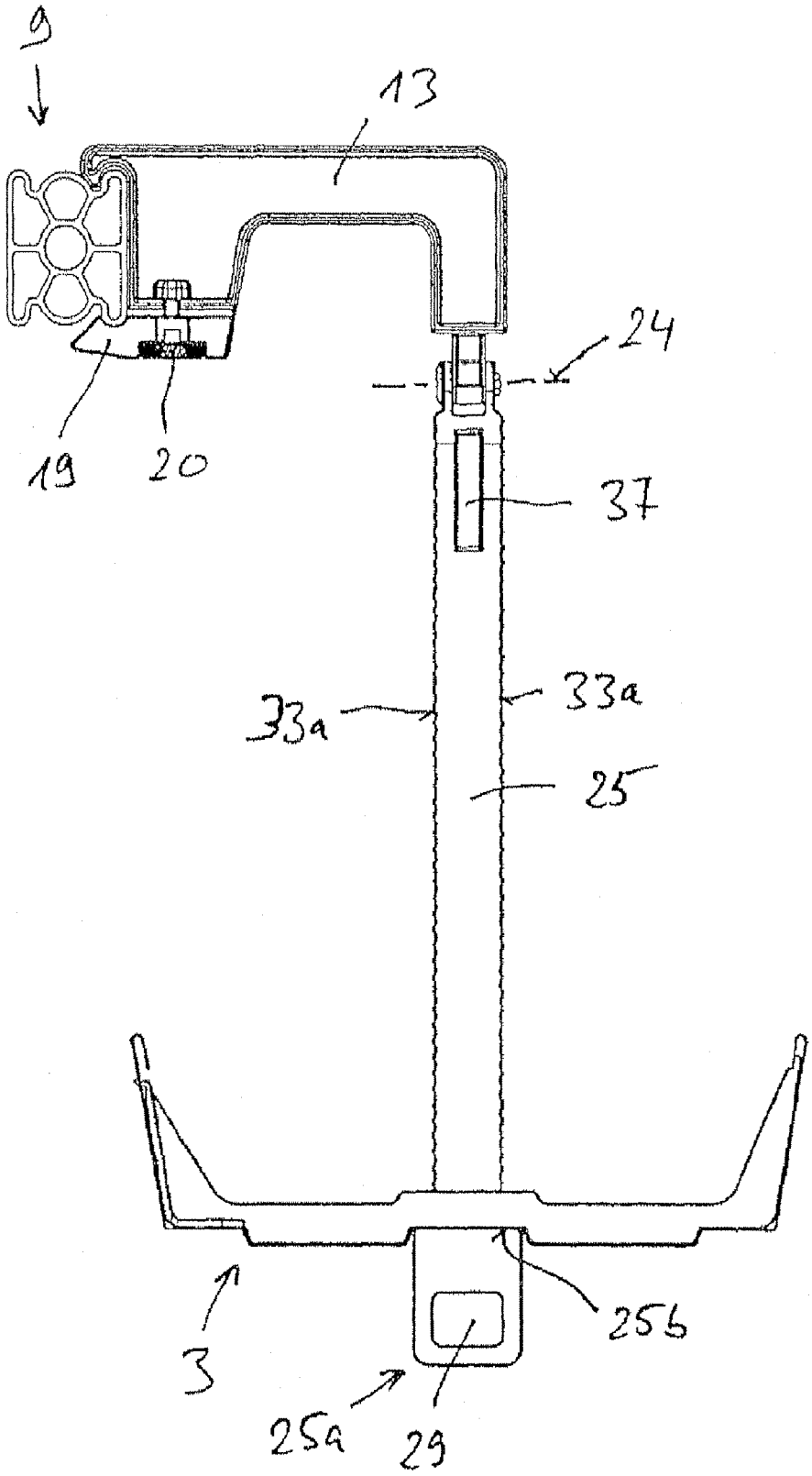

FIG. 1*c*: a cross section through a mounting device, a base body fastened thereon in lateral view, and a cable channel held by means of the base body in the raised operating position;

FIGS. 2*a*-2*c*: correspond to the illustrations of FIGS. 1*a*-1*a*, however with hanging down support rails in preparation for lowering the cable channel; and FIGS. 3*a*-3*c*: correspond to the illustrations of FIGS. 2*a*-2*c*, wherein however in relation to FIGS. 2*a*-2*c* the cable channel is adjusted in its dropped position.

An exemplary embodiment of the invention is explained below.

In FIGS. 1*a* and 1*b*, part of a work or office table 1 has been reproduced as an example of an item or piece of furniture, on which a cable channel 3 is provided which is still to be explained below.

The exemplary embodiment is explained below on the work or office table 1 mentioned, the right face of which is shown in FIG. 1*a* for example with a foot structure 5, consisting of a double T foot (or a C foot similar to the latter), although any arbitrary foot structure can be provided. Since the exemplary embodiment shown concerns an L-shaped corner table design, an angularly aligned single foot 5', which then comes to lie in the corner area of a corner table combination, only partly illustrated in FIG. 1*a*, is provided facing the foot structure 5 lying to the front in FIG. 1*a*.

A table or worktop 7 is merely indicated with broken lines in lateral view in accordance with FIG. 3*b*.

In the case of the table structure described a mounting device 9 is provided running in the longitudinal direction of the table or the desk top 7, which can consist for example of extruded metal and in addition has several chambers as can be seen from the sectional view in accordance with FIG. 1*c*.

On the upper and lower face 9*a* or 9*b* of this mounting device 9, recesses or undercuts 11 are formed, on which in the exemplary embodiment shown, two base bodies 13 are anchored lying offset in the longitudinal direction of the mounting device 9.

These base bodies 13 are formed, seen from the side, as a kind of reverse U, and on the side lying facing the mounting device 9 have fastening parts 15. For this purpose the base body 13 on its upper side 9*a* is provided with a support lug 17 lying on top, which engages in an undercut or a recess 11 pointing upwards in the base body. On the lower face 9*b* of the base body 13 a fixing cheek 19 is formed on the leg 13*a* lying adjacent to the mounting device 9, which for example can be screwed by means of a knurled thumb screw 20 from below into the leg 13*a* of the base body 13 (FIGS. 1*c*, 2*c* and 3*c*). At the same time a corresponding fixing lug 21 engages from below into a further recess or undercut 11 into the mounting device 9, so that when the screw 20 is tightened the base body 13, formed in this way, is firmly anchored on the mounting device 9.

By improving the handling of this fastening device the base body and the fixing cheek 19 can be connected to one another in an articulated way for example by a hinge link, e.g. a film hinge 22 or in another way, so that the fixing cheek 19 is held captively on the base body 13.

On the second leg 13*b* lying offset to the mounting device 9 a rotating axis 24, on which a support rail 25 is pivotally held, is formed on the lower face (FIGS. 1*c*, 2*c* and 3*c*).

In FIGS. 1*a*-1*c* the cable channel 3 is shown in its raised operating position. In this operating position it completely or almost reaches the upper face of the mounting device 9 and thus lies at a random short distance from the lower face of a table top 7 simply shown in FIG. 1*b*.

Since the cable channel beside a cable channel base 3*a* still has two lateral edge limits 3*b*, the cables laid therein are protected, but in this raised operating position cannot or practically cannot, or can only with great difficulty be installed in the cable channel or removed therefrom, should this be necessary.

In the operating position shown in FIGS. 1*a* to 1*c* in this case the cable channel 3 comes to lie at such a height that the rotating axis 24 mentioned comes to lie below the cable channel base 3*a*. This permits the support rail 25 fastened on this rotating axis 24 to be brought to a pivoted position, in which it runs parallel to the cable channel 3. Preferably lying nearer the free end 25*a* of the support rail 25 the support rail 25 can be fixed on the lower face of the cable channel, for which purpose a fixing device 27 is provided. In the exemplary embodiment shown this fixing device 27 comprises for example a ratchet or clamp or click mechanism 27*a*. In addition flexible locking levers, pre-tensioned beforehand, can be provided on the lower face of the cable channel 3, which for example in the ratcheted state straddle the side edges of the support rail 25 in gripping fashion. Likewise—as illustrated in FIG. 2*c* for example—the free end 25*a* of the support rail 25 can be provided with a recess 29, into which engages a corresponding ratchet, click or clamp finger, which is provided at a corresponding place on the cable channel lower face. In the exemplary embodiment shown the recess 29 is produced by two corresponding material sections arranged transversely to the plane of the support rail 25, as a result of which two clamp fingers 29*a* are formed. These are embodied flexibly in a resilient fashion and in the hinged condition of the support rail engage into corresponding recesses 3*c* in the base of the cable channel, as a result of which the support rail 25 is held due to the click or clamp fit.

In FIGS. 2*a* and 3*a* it is shown how the cable channel can be brought to its dropped cabling position.

For this purpose the two support rails 25, in the exemplary embodiment shown, with their snap connection between the support rail 25 and a fixing or clamp mechanism on the cable channel lower face released, are firstly pivoted around their rotating axis 24, until they hang freely down in the vertical direction, that is to say, run substantially perpendicularly to the cable channel 3. Also in this position shown in FIGS. 2*a*-2*c* the corresponding end section 13*b*' of the second leg 13*b* of the base body 13, with respect to its cross-sectional dimensions, can be dimensioned so that it corresponds approximately to the size of the opening 31 in the cable channel base, so that even when support rails 25 are hanging down, the cable channel is still held non-positively in its position shown in FIGS. 2*a*-2*c*, for example due to the friction effect generated as a result. Likewise another certain clamp effect can be provided in this support position, which still holds the cable channel in the raised position even when support rails 25 are hanging down.

In this position the cable channel can then be pushed down into the dropped cabling position in FIGS. 3*a*-3*c* and to be exact along the support rail 25. In the dropped position the cable channel 3 then rests on the end section 25*a* of the support rail 25, wherein the free end section 25*a* of the support rail 25 comprises a larger transverse extension forming an abutment 25*b*, on which the cable channel 3 rests and is held thereby.

As a result a large working space is provided between the cable channel and the plane of the upper mounting device 9 and the desktop located over it, only indicated in FIG. 2, so that now cables can be installed in the cable channel without a problem.

As can be inferred from the illustration in FIGS. 2*c* and 3*c*, the opposite narrow sides 33 of the support rails 25 are provided with a corrugation 33*a*, as a result of which a measure of distance, equal to or slightly larger than the size of the opening 31, is defined between the two opposite-lying corrugations 33*a*, so that the cable channel cannot fall freely down along the support rails 25 from its raised operating position into the dropped cabling position, but due to the friction effect generated as a result can be pushed carefully down.

After the cabling has been installed, the cable channel can again be lifted along the support rail 25 into its raised position and to be exact likewise again overcoming the friction effect between the corrugation 33*a* on the support rails 25 and the edges of the openings 31 in the cable channel base 3*a*. On reaching its highest operating position the described clamping, possibly provided, or a snap device arranged there, can function so that the cable channel is already held in its raised position shown in FIGS. 1*a* to 1*c*, even when the support rails 25 are still freely hanging down, as shown in FIGS. 2*a*-2*c*. Afterwards the support rails 25 are finally placed again into their horizontal fixing and support position around their rotating axis 24.

In order to prevent unwanted rattling, the support rails and/or the cable channel base lower faces can be provided for example with a slightly flexible, pre-tensioned spring mechanism 37, which is formed slightly arc-shaped in the exemplary embodiment shown and in the horizontal fixing position of the support rails rests on the lower face of the cable channel base 3*a*. The spring mechanism 37 mentioned can for example be provided at a place 37*a*, that is to say, preferably in close proximity to the rotating axis 24. In other words, the distance of this spring mechanism 37 to the rotating axis 24 is selected in such a way that it is less than 50%, in particular less than 40%, 30%, 20% and preferably even less than 10% of the entire length of the support rail 25.

As can be seen from the cross section illustrations through the cable channel 3, this is again provided with a stiffener 39 lying inside.

The adjustment according to the invention for the cable channel 3 explained was described for the case of a work or office table. The principle described for anchoring and adjusting a cable channel, however, can be used on any items of furniture, where the height of a cable channel is to be relatively adjusted, in particular beneath a top structure.

It has already been mentioned that the support rails 25 at least indirectly are held and anchored by means of a mounting device, preferably in the form of a side member. Exactly in the same way the support rails, however, could also be held directly or indirectly on the lower face of another mounting device, for example in the form of a wall, desk top etc. for example by means of a base body, which is attached to the table lower face. By means of corresponding rotating axes 24 the support rails also here can be adjusted relative to a base body fixed in this way between a cabling position and an operating position.

The rotating axis mentioned can consist of a normal rotating axis, in particular if support rails and base bodies are used, which consist of a correspondingly suitable material, for example metal, plastic etc. Exactly in the same way, a bend-flexible pivoting mechanism however could also be provided here. In this respect, the concept is in no way limited to specific embodiments.

The invention claimed is:

1. Furniture, especially a table with a cable channel, comprising:

the cable channel is adjustable between a raised operating position and, in relation to the latter, a lowered cabling position, base bodies lying offset from one another in the longitudinal direction of the cable channel are provided on a mounting device, on the base bodies in each case a support rail is pivotable around a rotating axis between a dropped cabling position substantially perpendicular to the cable channel and a support position substantially parallel to the cable channel, wherein with the support rail in the dropped cabling position, the cable channel is displaceable from the raised operating position the lowered cabling position, and the support rail in the support position secures the cable channel in the raised operating position, and lying offset from the rotating axis, an abutment is constructed on the support rails, wherein the cable channel in the dropped cabling position directly or indirectly rests on the abutment in a lower lying plane relative to the raised operating position.

2. Furniture according to claim 1, wherein the support rails running pivoted in the raised operating position or the support position parallel to the cable channel are held at least indirectly by means of a fixing device, the fixing device comprising a ratchet or clamp mechanism on the lower face of the cable channel.

3. Furniture according to claim 1, further comprising recesses provided in the cable channel through which the support rail and/or, dependent upon the situation of the cable channel, a part of the base body also extends, so that the cable channel is adjustable along the support rail between a raised operating position and a dropped cabling position.

4. Furniture according to claim 3, wherein a longitudinal and/or transverse dimension of the support rail is limited so that it approximately corresponds to the longitudinal or transverse dimension of the recesses in the cable channel to generate a friction effect.

5. Furniture according to claim 3, wherein the support rail at least on at least two opposite-lying longitudinal and/or two opposite-lying transverse sides is provided with a corrugation, wherein a friction effect can be generated when the cable channel is raised or lowered relative to the support rail.

6. Furniture according to claim 5, wherein the support rail passes through the opening of the cable channel approximately centrally.

7. Furniture according to claim 3, wherein the support rail passes through the opening of the cable channel approximately off-centre, so that an overturning moment is introduced on the support rail by the weight of the cable channel.

8. Furniture according to claim 1, wherein the respective rotating axis of a support rail is aligned transversely to the longitudinal direction of the cable channel, so that the associated support rail is pivoted in the longitudinal direction of the cable channel and is fixed on its lower face.

9. Furniture according to claim 1, wherein the support rail on its free end, lying opposite the rotating axis, is provided with a closing clip.

10. Furniture according to claim 1, comprising rattling prevention in the form of a spring mechanism, whereby the support rail is held against a lower face of the cable channel by a pre-tension created by the spring mechanism.

11. Furniture according to claim 1, wherein the base body comprises a fixing lug, with which it can be suspended in a corresponding first recess formed in the base body.

12. Furniture according to claim 11, wherein the base body is equipped with a fastening part, which comprises the fixing lug, which in the anchorage position on the mounting device engages into a second recess on a side of the mounting device, which lies opposite the first recess formed on the other side of the mounting device, into which the fixing lug of the base body engages.

13. Furniture according to claim 12, wherein the fastening part is connected in an articulated way to the base body, by means of a hinge.

14. Furniture according to claim 12, wherein the fastening part is fixed on the associated base body by means of a knurled thumb screw while fixed to the mounting device.

15. Furniture according to claim 1, wherein the mounting device comprises a mounting piece running parallel to the cable channel.

* * * * *